United States Patent [19]

Fabrig

[11] 4,325,545

[45] Apr. 20, 1982

[54] METHOD AND APPARATUS FOR ALIGNING STACKED PAPER SHEETS OR THE LIKE

[75] Inventor: Paul Fabrig, Neuffen, Fed. Rep. of Germany

[73] Assignee: Womako Maschinenkonstrucktionen GmbH, Nürtingen, Fed. Rep. of Germany

[21] Appl. No.: 156,634

[22] Filed: Jun. 4, 1980

[30] Foreign Application Priority Data

Dec. 15, 1979 [DE] Fed. Rep. of Germany ..... 2950616

[51] Int. Cl.[3] ..... B65H 31/34

[52] U.S. Cl. ..... 271/221; 271/233; 414/28

[58] Field of Search ..... 271/221, 222, 210, 209, 271/233; 414/28, 113; 11/1 A; 493/419

[56] References Cited

U.S. PATENT DOCUMENTS

| | | | |
|---|---|---|---|
| Re. 27,814 | 11/1973 | Hanson | 271/209 |
| 3,711,088 | 1/1973 | Salvade | 271/222 |
| 3,992,002 | 11/1976 | Fassman et al. | 271/221 |

OTHER PUBLICATIONS

Sokol, G. L., "Stacked Envelope Aligner", *IBM Technical Disclosure Bulletin,* vol. 19, No. 9, Feb. 1977, pp. 3241–3242.

*Primary Examiner*—Bruce H. Stoner, Jr.
*Attorney, Agent, or Firm*—Kontler & Grimes

[57] ABSTRACT

Stacks of paper sheets wherein a first marginal portion of a relatively large second sheet extends beyond the corresponding first marginal portions of two piles of relatively small first sheets, wherein the second sheet is disposed between the two piles of first sheets and wherein at least some first sheets are often out of exact alignment with the remaining (aligned) first sheets are treated in an apparatus wherein an inclined first surface supports one side of a stack and a second surface at the lower end of the first surface is provided on a stop for those (second) marginal portions of the sheets which are remote from the first marginal portions. The misaligned first sheets are moved into exact register with the remaining first sheets by shifting them toward the second surface so that their second marginal portions contact the stop. This is accomplished by resorting to abutments which contact both sides of the first marginal portion of the second sheet and are movable toward the second surface to engage the first marginal portions of misaligned first sheets and to move such sheets toward the stop. The abutment at one side of the first marginal portion of the second sheet is movable into deforming engagement with the adjacent section of such first marginal portion to deform the second sheet prior to shifting of misaligned first sheets toward the stop.

34 Claims, 4 Drawing Figures

1
38
1a
41
6
132
200
32
34
46
47
44
16
2A
4'
33
13
9
2
7
8
27
21
43
42
3
18
19
17
26
37
39
X
11a
11

METHOD AND APPARATUS FOR ALIGNING STACKED PAPER SHEETS OR THE LIKE

BACKGROUND OF THE INVENTION

The present invention relates to a method and apparatus for aligning stacked paper sheets or the like so that the neighboring sheets accurately overlap each other. More particularly, the invention relates to improvements in a method and apparatus for aligning sheets in a stack which contains at least one sheet or panel whose dimensions exceed the dimensions of the other sheets. Still more particularly, the invention relates to a method and apparatus for aligning the sheets or panels of a stack wherein a marginal portion of at least one sheet or panel or panel extends beyond one edge face of the major portion of the stack.

It is often necessary to manipulate stacks of paper sheets or the like prior to conversion into steno pads, note books, calendars, exercise books or analogous stationery products in order to ensure that each and every sheet or panel (hereinafter called sheet) of a stack will accurately register with (i.e., overlie or be overlapped by) the neighboring sheet or sheets. The aligning procedure is relatively simple, at least in most instances, if the entire stack consists of identical sheets. Thus, it is customary to cause one edge face of the stack to abut against a suitable stop while the stack rests on a supporting surface, and the edge face which is located opposite the one edge face is engaged by a suitable tool to shift the projecting or misaligned sheets toward the stop. Such procedure is quite satisfactory and can be carried out by resorting to relatively simple instrumentalities, as long as the dimensions of all sheets in the stack are identical. However, if the stack contains at least one sheet (which may be an outermost sheet or an intermediate sheet) whose dimensions exceed the dimensions of other sheets in the stack, the just discussed conventional procedure is unsatisfactory because the aforementioned shifting tool is likely to damage the adjacent marginal portion or portions of the larger sheet or sheets during movement toward the stop. Relatively large intermediate or outermost sheets are often desirable to constitute separators between smaller piles of sheets within a larger stack, to facilitate convenient and rapid opening of a book or pad at a desired page, or for other purposes.

OBJECTS AND SUMMARY OF THE INVENTION

An object of the present invention is to provide a novel and improved method of aligning stacked sheets which include at least one larger sheet in such a way that the larger sheet or sheets of the stack are not defaced, deformed and/or otherwise damaged in the course of the aligning step.

Another object of the invention is to provide a novel and improved method of aligning stacked sheets which include one or more larger sheets in such a way that the aligning operation is reliable, that such operation can be completed within a surprisingly short interval of time, and that the larger sheet or sheets of the stack are not deformed (even for a short interval of time following completion of the aligning operation), defaced or otherwise damaged regardless of the extent to which they project beyond the other sheets of the stack.

A further object of the invention is to provide a method of the above outlined character which can be resorted to for proper alignment of sheets in relatively large or relatively small stacks, which can be practiced with equal efficiency irrespective of whether the larger sheet or sheets are nearer to the one or the other outermost sheet of the respective stack, and which can be practiced even if the larger sheet or sheets are the outermost sheets of the stack and even if the extent to which the larger sheet or sheets project beyond the other sheets is extremely small.

An additional object of the invention is to provide a novel and improved apparatus for the practice of the above outlined method.

Another object of the invention is to provide the apparatus with novel and improved means for preventing deformation of and/or other damage to the larger sheet or sheets of a stack while the stack is being manipulated to move all of its sheets into requisite alignment with each other.

A further object of the invention is to provide the apparatus with novel and improved means for displacing (if necessary) relatively small sheets at one or both sides of one or more relatively large sheets.

An additional object of the invention is to provide an apparatus of the above outlined character which can be installed in a modern high-speed spiral binding or analogous machine for conversion of stacked sheets of paper or the like into note books, steno pads, calendars or analogous stationery or bookstore products.

One feature of the invention resides in the provision of a method of aligning the sheets (which are normally square or rectangular) of a stack which includes aligned and misaligned relatively small first sheets and at least one relatively large second sheet having a first marginal portion extending beyond the corresponding first marginal portions of the first sheets, wherein the first marginal portions of the misaligned first sheets extend beyond the first marginal portions of the aligned first sheets, and wherein the sheets have second marginal portions located opposite the respective first marginal portions and the second marginal portions of aligned first sheets extend beyond the second marginal portions of misaligned first sheets. The method comprises the steps of locating one side of the stack against a first surface (e.g., against the downwardly inclined exposed flat surface of a plate-like stationary support), placing the second marginal portions of aligned first sheets against a second surface which is inclined (preferably at right angles) to the first surface (the second surface may constitute the flat upper side or surface of a stop which is located at the lower end of the aforementioned downwardly inclined plate-like support) whereby the first marginal portions of misaligned first sheets extend beyond the first marginal portions of aligned first sheets (i.e., of those first sheets whose second marginal portions contact the second surface), and shifting the misaligned first sheets with reference to aligned first sheets so as to move the second marginal portions of misaligned first sheets into contact with the second surface.

The shifting of all misaligned first sheets toward and into contact with the second surface can be facilitated by adding the step of temporarily deforming the first marginal portion of the second sheet so as to move at least one section of the thus deformed first marginal portion of the second sheet away from the neighboring section of the first marginal portion of the nearest first sheet, at least at one side of the second sheet (depending upon whether the second sheet is located between two piles or groups of first sheets or constitutes an outermost sheet of the stack). The shifting step then preferably includes applying against the first marginal portions of misaligned first sheets a force in a direction toward the second surface in the region of the aforementioned section of the first marginal portion of the nearest first sheet.

The deforming step may include imparting to the first marginal portion of the second sheet a substantially undulate shape. Such deformation of the first marginal portion of the second sheet can be achieved by holding at least one first section of the first marginal portion of the second sheet against movement away from the first surface and moving a second section of the first marginal portion of the second sheet away from the first surface. Alternatively, the deforming step (to impart to the first marginal portion of the second sheet an undulate shape) can be achieved by urging at least one first section of the first marginal portion of the second sheet toward the first surface and moving a second section of the first marginal portion of the second sheet away from the first surface.

The second sheet can be disposed between first and second groups or piles of smaller first sheets of the stack. In the treatment of such stacks, deformation of the first marginal portion of the second sheet so as to impart thereto an undulate or substantially undulate shape results in movement of certain sections of the deformed first marginal portion of the second sheet away from the neighboring sections of first marginal portions of the nearest sheets of both piles of first sheets upon completion of the deforming step. The shifting step then includes applying a force against the first marginal portions of misaligned first sheets of both piles of first sheets in regions where the sections of first marginal portions of the nearest first sheets are spaced apart from the respective sections of the first marginal portion of the second sheet.

The method may further comprise the step of applying a force against the first marginal portion of the second sheet in a direction toward the second surface so as to shift the second marginal portion of the second sheet toward and into contact with the second surface if the second marginal portion of the second sheet was out of contact with the second surface upon completion of the locating step. Otherwise stated, if the stack, one side of which rests on or otherwise contacts the first surface, is in such condition that the second marginal portion of the second sheet is initially out of contact with the second surface, the second sheet is shifted in parallelism with the plane of the preferably flat first surface so as to move the second marginal portion of the second sheet relative to aligned first sheets and into contact with the second surface. Such shifting of the second sheet (if and when necessary) can take place prior to, during or after shifting of misaligned first sheets into contact with the second surface.

As used in the preceding description of the improved method, the term "second sheet" is intended to embrace a single second sheet or two or more neighboring second sheets which may but need not be exactly aligned with each other, i.e., one or more of which may require some alignment (application of a force in a direction toward the second surface) before the stack is removed from the position of contact with the first and second surfaces.

Deformation of the first marginal portion of the second sheet is temporary, i.e., it does not last much longer than or is terminated simultaneously with completion of alignment of certain sheets of the stack. This ensures that the aligning operation does not leave any permanent marks on the second sheet and/or on the originally misaligned first sheets, i.e., the treatment of sheets is gentle even if the sheets are rather thin and prone to permanent deformation in response to the application of relatively small forces against their first marginal portions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
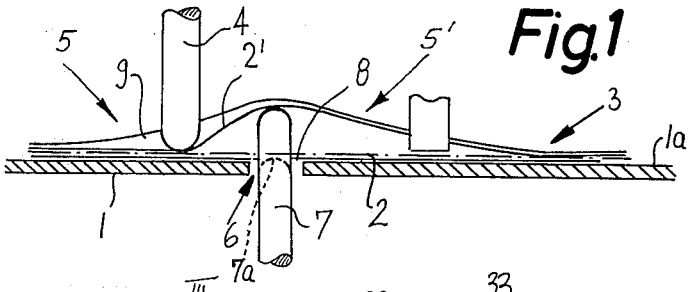
FIG. 1 is a fragmentary schematic transverse sectional view of an apparatus which embodies one form of the invention.

FIG. 1 illustrates certain components of a first apparatus which can be used for the practice of the improved method. The apparatus serves to properly align the sheets of a stack 3 one side of which rests on the exposed flat surface 1*a* of a support 1 in such a way that one edge face of the stack 3 abuts against the surface of a suitable stop, such as the flat upper surface 11*a* of the stop 11 shown in the lower right-hand portion of FIG. 4. That portion of the stack 3 which is visible in FIG. 1 includes its edge face, i.e., that edge face which corresponds to the upper edge face of the stack 3 shown in FIG. 4 and which is remote from the stop 11. The purpose of the apparatus is to accurately align all sheets of the stack 3 or at least those sheets whose dimensions are identical. The stack 3 of FIG. 1 has a single intermediate sheet 2 which is larger than the other sheets (such other sheets include those numbered 8 and 9). The first or upper marginal portion 2A (see FIG. 4) of the larger sheet 2 extends forwardly (toward the observer of FIG. 1) beyond the other sheets, i.e., this marginal portion of the sheet 2 projects from the stack 3 beyond the corresponding (first) marginal portions of the neighboring (smaller) sheets 8 and 9. The sheet 8 is adjacent to that side of the larger sheet 2 which faces the surface 1*a* of the support 1, and the sheet 9 is adjacent to the upper side of the larger sheet 2, as viewed in FIG. 1. If desired, the larger sheet 2 can have one or more additional marginal portions which extend beyond the corresponding marginal portions of the smaller sheets including those shown at 8 and 9.

The stack 3 can be fed onto the support 1 by an automatic or semiautomatic conveyor system, or it may be deposited on the surface 1*a* of the support 1 by hand. It goes without saying that the stack 3 can contain a substantial number of smaller sheets at both sides of the larger sheet 2, that the stack can contain several larger sheets 2 (which are preferably placed adjacent to each other), or that the stack can contain one or more neighboring larger sheets one of which is an outermost sheet of the respective stack.

Prior to start of the aligning operation, all sheets of the stack 3 on the support 1 are parallel to the exposed surface 1*a* of the support 1 (thus, all smaller sheets are parallel to the larger sheet 2 which is indicated by phantom lines). The plane of the surface 11*a* is normal to the plane of the surface 1*a*.

In accordance with a feature of the invention, the apparatus, a portion of which is illustrated in FIG. 1, includes a first abutment 4 which extends toward but short of the exposed surface 1*a* of the support 1 so that it contacts the upper side of the marginal portion 2A of the sheet 2 (while the latter assumes its phantom-line position). Thus, the abutment 4 engages the exposed portion of the larger sheet 2, namely, that marginal portion which extends forwardly beyond the other sheets (including the sheets 8 and 9) of the stack 3. As mentioned above, FIG. 4 shows the projecting edge portion of the larger sheet 2 at 2A. The distance between the abutment 4 and the surface 1*a* can be fixed in advance with a high degree of accuracy if each of a series of successive stacks 3 contains the same number of sheets and the larger sheet 2 of each stack 3 is located in the same position, namely, if each larger sheet 2 is separated from the two outermost sheets of the respective stack by predetermined first and second numbers of intermediate sheets. By way of example, each of a series of stacks 3 which are treated in the apparatus of FIG. 1 can contain 100 sheets of normal (smaller or first) size and a larger (second) sheet 2, and the larger sheet 2 is flanked by two piles or groups of 50 smaller sheets each. In such instances, it is rather simple to select the distance between the tip of the abutment 4 and the surface 1*a* in such a way that the tip invariably contacts the marginal portions 2A of larger sheets 2 in successive stacks 3.

The apparatus of FIG. 1 further comprises a second abutment 7 which can be moved between a retracted position (the tip of the abutment 7 in retracted position is indicated by broken lines, as at 7*a*) and an extended position which is shown by solid lines. In the retracted position of the abutment 7, its tip is confined in an opening or window 6 of the support 1. It will be noted that the abutments 4 and 7 are staggered or offset relative to each other, considered in the longitudinal direction of the marginal portion 2A of the sheet 2. This renders it possible to move the abutment 7 to the extended (solid-line) position whereby the tip of the abutment 7 preferably deforms the marginal portion 2A and, through the medium of such marginal portion, the major part of or the entire stack 3. Thus, if the larger sheet 2 is relatively stiff and/or if the marginal portion 2A is relatively narrow, lifting of the abutment 7 to the solid-line position of FIG. 1 results in lifting of certain sections of all smaller sheets (including a section of the sheet 9) which are located above the sheet 2 in a direction upwardly and away from the surface 1*a*; at the same time, the smaller sheets (including the sheet 8) which are located between the larger sheet 2 and the surface 1*a* need not change their positions as a result of deformation of the marginal portion 2A in response to upward movement of the tip of the abutment 7 beyond the surface 1*a*.

At the same time, the tip of the abutment 4 (such tip is maintained at a fixed distance from the surface 1*a*) holds the adjacent section of the marginal portion 2A of the larger sheet 2 against movement away from the surface 1*a* or biases the portion 2A toward the support 1. If the abutments 4 and 7 are sufficiently close to each other, lifting of the abutment 7 to the solid-line (extended) position invariably entails at least some movement of certain sections of smaller sheets in the region of the abutment 4 above and away from the corresponding (depressed) section of the marginal portion 2A (such section of the marginal portion 2A is held against movement above and away from the surface 1*a* by the tip of the abutment 4).

Owing to conversion of the elongated marginal portion 2A into a strip of undulate shape, the uppermost part of the abutment 7 (in the extended position of this abutment) is located in front of the corresponding marginal portions of smaller sheets (including the sheet 8) which are located between the sheet 2 and the surface 1*a*, and the lowermost portion of the abutment 4 is located in front of front marginal portions of smaller sheets (including the sheet 9) which are disposed above the larger sheet 2. The abutments bridge the gaps between the deformed sections of the marginal portion 2A on the one hand and the adjacent sections of the smaller sheets on the other hand. Consequently, if the abutments 4 and 7 (while the abutment 7 continues to dwell in the extended position to impart to the marginal portion 2A of the larger sheet 2 the undulate shape shown in FIG. 1) are thereupon shifted in a direction away from the observer of FIG. 1, they engage all forwardly protruding (misaligned) smaller sheets and move the rear marginal portions of such smaller sheets toward and into contact with the surface of the stop at the rear end of the stack 3, e.g., toward the surface of a stop corresponding to the stop 11 shown in FIG. 4. The undulate shape of the marginal portion 2A is denoted in FIG. 1 by a solid line, as at 2'. A first section of the undulate marginal portion 2' is shown at 5 (this section is held against movement away from the surface 1*a* by the tip of the abutment 4), and a second section of the undulate marginal portion 2' is indicated at 5' (this section has been lifted above and away from the surface 1*a* in response to movement of the abutment 7 to its extended position). The section 5 is spaced apart from adjacent sections of smaller sheets above the larger sheet 2, and the section 5' is spaced apart from the adjacent sections of smaller sheets between the larger sheet 2 and the surface 1*a*. The formation of these sections by causing the marginal portion 2A to assume an undulate shape (at 2') enables the abutments 4 and 7 to engage the first marginal portion of each and every protruding (misaligned) smaller sheet at both sides of the larger sheet.

If desired, the apparatus can comprise a third or auxiliary abutment 200 (see FIG. 4) which is located forwardly of the abutments 4 and 7, as viewed in FIG. 1 (i.e., nearer to the observer of FIG. 1) and shares the movements of the abutments 4 and 7 in directions at right angles to the plane of FIG. 1. The purpose of the auxiliary abutment 200 is to move the larger sheet 2 toward the stop 11 when the abutments 4 and 7 shift the protruding marginal portions of smaller sheets above and below the sheet 2 relative to the other (aligned) smaller sheets (i.e., toward the stop 11). The auxiliary abutment 200 can be located at a relatively large distance from the abutments 4 and 7 (as considered at right angles to the plane of FIG. 1) so as to provide room for convenient insertion of a stack 3 even if the marginal portion 2A of the larger sheet 2 in such stack extends well beyond the corresponding marginal portions of the smaller sheets (i.e., if the larger sheet 2 must be shifted toward the stop 11). The apparatus then comprises a suitable mechanism which moves the abutment 200 at a speed exceeding the speed of the abutments 4, 7 while the abutments 4, 7 and 200 move toward the stop 11 to thus ensure that the protruding marginal portion 2A (of the deformed sheet 2') is actually moved toward the stop. Alternatively, the extent of movement of the auxiliary abutment 200 toward and away from the stop 11 can exceed the extent of movement of abutments 4 and 7 toward and away from the same stop.

Figure 4:
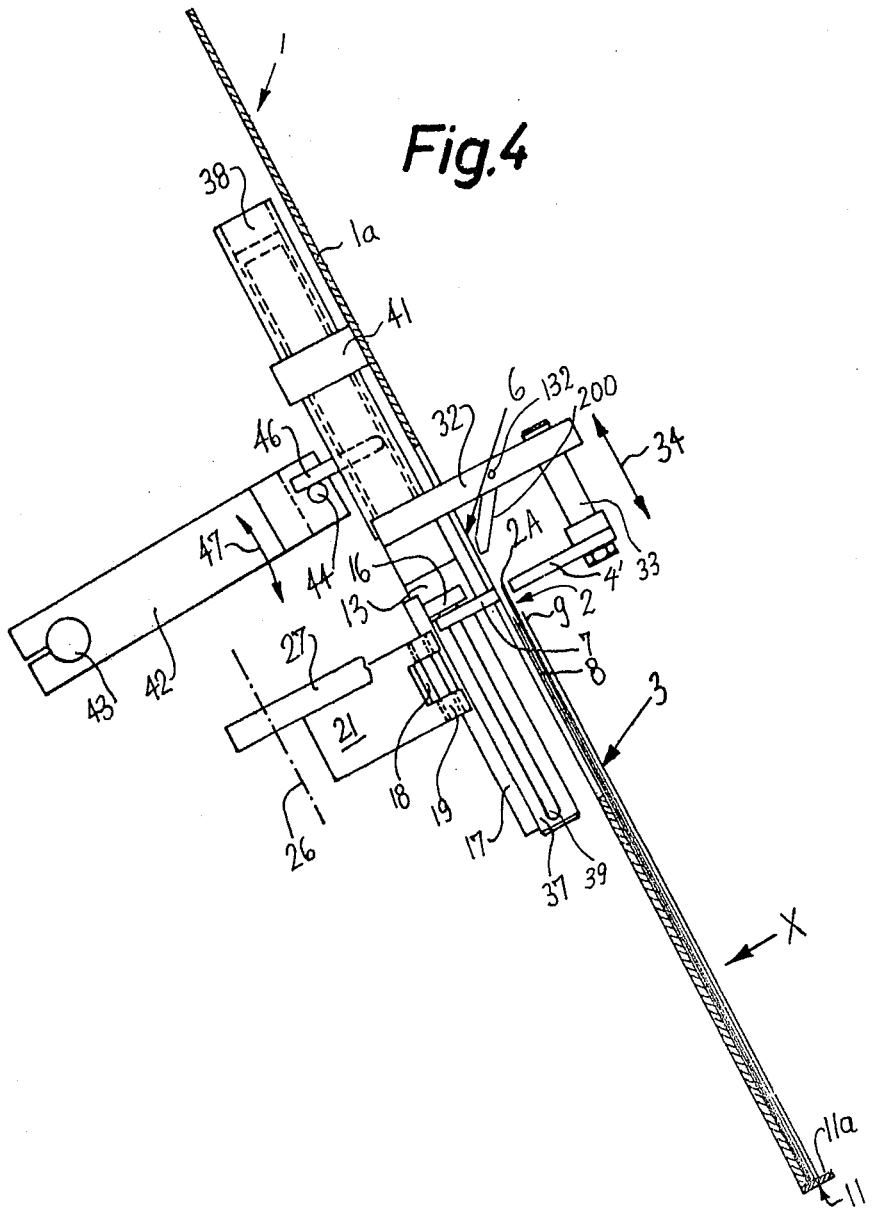
FIG. 4 is a side elevational view of the second apparatus as seen in the direction of arrow IV in FIG. 2 or 3, with certain parts shown in section.

The stop 11 is disposed at the lower end of the surface 1*a*, as viewed in FIG. 4. The parts 1 and 11 together constitute a means for locating the stack 3 in a predetermined position, namely, in a position in which the upper or first marginal portions of misaligned smaller sheets extend upwardly beyond the first marginal portions of aligned smaller sheets, in which the second marginal portions of aligned smaller sheets contact the surface 11*a* but the second marginal portions of misaligned smaller sheets are out of contact with the surface 11*a* (i.e., the second marginal portions of aligned smaller sheets extend downwardly and beyond the second marginal portions of misaligned smaller sheets), in which the first marginal portion 2A of the larger sheet 2 extends upwardly and beyond the first marginal portions of all smaller sheets, and in which the second marginal portion of the larger sheet 2 may but need not necessarily contact the surface 11*a*. One side of such stack 3 contacts (i.e., lies against) the downwardly sloping surface 1*a* of the support 1. The surface 1*a* is located at the exposed side of the support 1, and the other side of this support faces away from the stack on the surface 1*a*.

The auxiliary stop 200 is optional because successive stacks 3 can be readily delivered to the support 1 in a condition such that the second marginal portion of the larger sheet 2 (the second marginal portion is that marginal portion which is remotest from the observer of FIG. 1) invariably abuts against the aforementioned stop when one side of a fresh stack 3 is properly positioned on the surface 1*a*. Moreover, if desired, the auxiliary abutment 200 can be actuated by a suitable mechanism (which may but need not be identical with or analogous to the shifting mechanism for the abutments 4 and 7) so as to move the larger sheet 2 of a freshly inserted stack 3 toward and against the stop (provided that the larger sheet 2 was out of contact with the stop) before the abutment 7 is moved to the extended position, i.e., before the abutments 4 and 7 begin to move away from the observer of FIG. 1 in order to move the protruding (misaligned) smaller sheets against the stop.

It is further clear that the abutments 4 and 7 need not necessarily move in unison, i.e., the movement of the abutment 4 away from the observer of FIG. 1 to align the protruding smaller sheets above the sheet 2 by moving them against the stop can precede the corresponding movement of the abutment 7, or vice versa. Simultaneous movements of the abutments 4 and 7 (or of all three abutments) are preferred at this time because this simplifies the design of the shifting means and contributes to compactness of the apparatus. In addition, a complete cycle takes up a shorter interval of time if two or all three abutments are moved as a unit toward as well as away from the stop 11 or an analogous component of locating means for the stacks.

Such mounting of one of the abutments 4 and 7 that the displacement of the mobile abutment (this is the abutment 7 of FIG. 1) results in deformation (undulation) of the first marginal portion 2A of the larger sheet or sheets 2 is preferred because it contributes to reliability of the apparatus, i.e., the abutments 4 and 7 are then certain to engage all protruding (misaligned) smaller sheets and to move such protruding sheets into engagement with the stop. However, and especially if the tips of the abutments 4 and 7 are not rounded (but pointed or flattened), the apparatus can be simplified by installing the abutment 7 in such a way that its tip is always located at a fixed distance from and above the surface 1*a*. This distance equals or closely approximates the anticipated thickness of the pile of smaller sheets (including the sheet 8 of FIG. 1) between the sheet 2 and the surface 1*a*. Such simplified apparatus can also ensure adequate alignment of at least the majority of protruding (misaligned) smaller sheets even though its abutments cannot deform the edge portion 2A of the larger sheet.

The advantage of the apparatus which is shown in FIG. 1 over the just discussed simplified apparatus (wherein the abutments 4 and 7 are merely movable at right angles to the plane of FIG. 1 but the abutment 7 is always held in a preselected extended position) will be readily appreciated. Thus, by the simple expedient of slightly deforming the marginal portion 2A of the larger sheet 2, one can ensure that each and every protruding (misaligned) smaller sheet will be moved into engagement with the stop 11 or an analogous stop because the abutments 4 and 7 separate the engaged sections of the marginal portion 2A from adjacent sections of the corresponding smaller sheets.

Moreover, deformation of the marginal portion 2A of the larger sheet 2 is desirable if the sheet 2 is misaligned, i.e., if the second marginal portion (opposite the marginal portion 2A) of the sheet 2 is out of contact with the surface 11*a* when a stack 3 is placed onto the surface 1*a*. Such deformation of the marginal portion 2A by the abutment 7 stiffens the latter so that the marginal portion 2A is less likely to be permanently deformed (e.g., dented) by the auxiliary abutment 200 when the latter is shifted toward the stop 11 to move the larger sheet 2 to an optimum position of contact between its second marginal portion and the surface 11*a*.

Still further, deformation of the marginal portion 2A by the abutments 4 and 7 entails at least some deformation of at least some smaller sheets at one or both sides of the larger sheet 2 so that the resistance of first marginal portions of the smaller sheets to permanent deformation also increases, i.e., the first marginal portions of misaligned smaller sheets are less likely to be permanently deformed by the abutment 4 and/or 7 when these abutments are shifted toward the surface 11*a* to move from their first positions (at a maximum distance from the stop 11) to their second end positions (at a minimum distance from the stop 11) in which the distance between the abutments 4, 7 on the one hand and the surface 11*a* on the other hand equals the height of smaller sheets (as considered in the direction of reciprocatory movement of the abutments 4 and 7).

Figure 2:
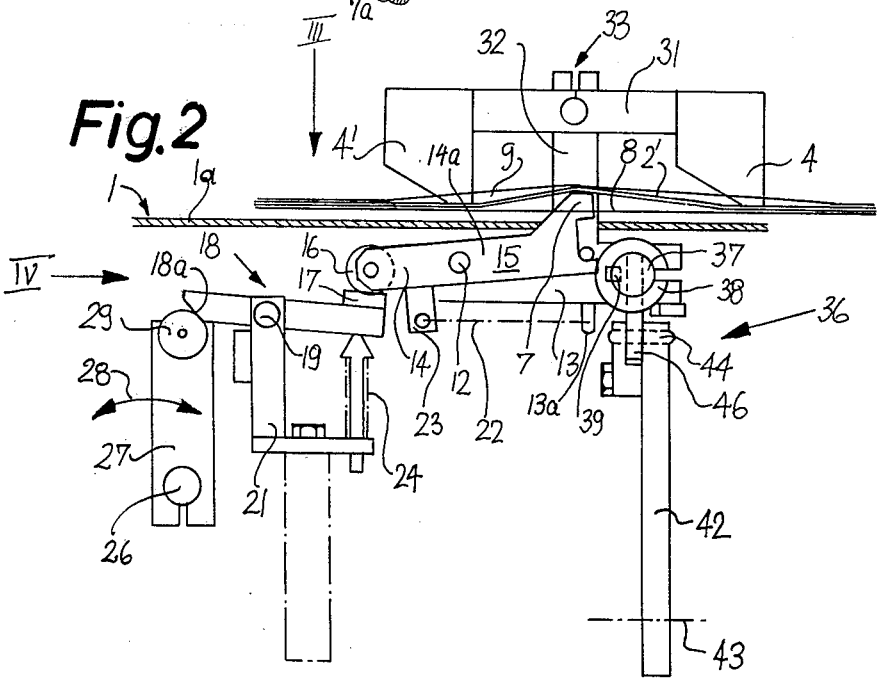
FIG. 2 is a transverse sectional view of a modified apparatus.
Figure 3:
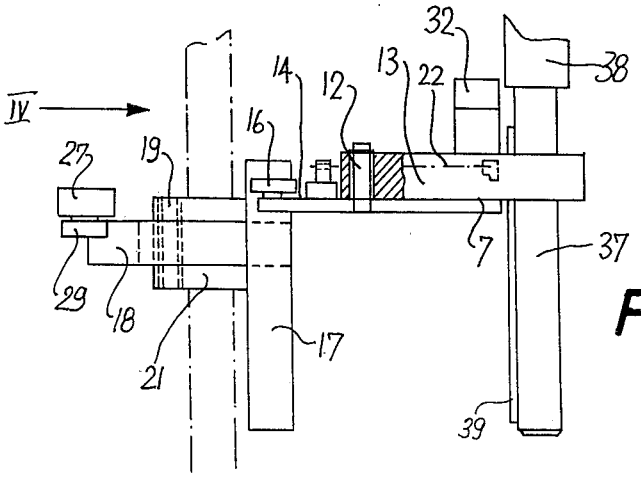
FIG. 3 is a fragmentary elevational view as seen in the direction of arrow III in FIG. 2.

FIGS. 2 to 4 illustrate a second embodiment of the improved apparatus. The main difference between the apparatus of FIG. 1 on the one hand and the apparatus of FIGS. 2–4 on the other hand is that the latter apparatus comprises a two-piece or two-part abutment 4, 4' which is located at a fixed distance from the exposed flat surface 1*a* of the downwardly sloping plate-like support 1. The spacing between the parts 4 and 4' of the composite abutment 4, 4' suffices to provide ample room for the reciprocable and shiftable abutment 7 which can be moved between the extended position of FIG. 2 and the retracted position of FIG. 4, preferably midway or nearly midway between the parts 4 and 4'. This further reduces the likelihood that the abutments 7 and 4, 4' would miss one or more protruding (misaligned) smaller sheets during shifting of such abutments toward the stationary stop 11 at the lower end of the support 1.

The support 1 and the stop 11 can constitute a locating means which is made of a single piece of metallic or other suitable material and resembles a simple trough into which the stacks 3 can be placed, one after the other, either by moving a series of stacks in a plane at right angles to the plane of FIG. 4, i.e., in a direction from the right to the left (or vice versa), as viewed in FIG. 2, or by moving successive stacks in the direction of arrow X, namely, at right angles to the plane of the surface 1*a*. In the latter instance, care should be taken that the edge portion 2A of the larger sheet 2 is moved to the position of FIG. 4, i.e., to the left of the tips of parts 4 and 4' (of which only the part 4' is shown in FIG. 4).

The inclination of the surface 1*a* of the support 1 is sufficient to enable the sheets of a stack 3 which has been placed against the surface 1*a* to slide downwardly and to come to rest when the lower marginal portions of its sheets contact the surface 11*a* of the stop 11. The marginal portion 2A of the larger sheet 2 extends upwardly beyond the corresponding upper or first marginal portions of the smaller sheets at both sides of the larger sheet 2. As shown in FIG. 2, the parts 4 and 4' of the composite outer abutment (4+4') are adjacent to the outer side of the marginal portion 2A, namely, to that side of the marginal portion 2A which faces away from the surface 1*a*. The tips of the parts 4 and 4' are preferably located in a plane which is parallel to the plane of the surface on the stop 11. Such tips abut against (i.e., they contact) the outer side of the marginal portion 2A. As mentioned hereinabove, the reciprocable abutment 7 is located between the parts 4, 4' of the other abutment and is movable between the retracted position of FIG. 4 (in which its tip does not extend outwardly eyond the surface 1*a*) and the extended position of FIG. 2 in which its tip extends beyond the surface 1*a* and causes the marginal portion 2A between the parts 4, 4' to assume an arcuate shape, namely, a shape corresponding to that of a portion of a wave. The crest of such arcuate section of the marginal portion 2A is located at the tip of the abutment 7. The abutment 7 can extend outwardly beyond the surface 1*a* through an opening or window 6 in the support 1. The configuration of the opening 6 is such that it allows for shifting of the abutment 7 in directions toward and away from the surface 11*a* of the stop 11 (see the arrow 34). The tips of the parts 4, 4' and of the abutment 7 are located in a common plane, namely, in the aforementioned plane which is parallel to the plane of the surface 11*a* on the stop 11.

The abutment 7 of the apparatus shown in FIGS. 2–4 is a protuberance at the free end of one arm 14*a* of a two-armed lever 15 which is fulcrumed on a shaft 12 mounted in a carrier 13. The other arm 14 of the lever 15 is provided with a roller follower 16 which tracks an elongated cam face 17 at the free end of one arm of a second lever 18. The latter is fulcrumed on a shaft 19 which is mounted in a stationary frame 21 of the apparatus.

The lever 15 is biased in a counterclockwise direction, as viewed in FIG. 2, by a relatively weak helical spring 22 one end convolution of which is affixed to a lug 23 on the left-hand arm 14 of the lever 15 and the other end convolution of which is attached to a lug 13*a* of the carrier 13. Thus, the spring 22 tends to maintain the abutment 7 in the extended position of FIG. 2.

A stronger second spring 24 tends to move the abutment 7 of the lever 15 to the retracted position of FIG. 4. The second spring 24 reacts against the frame 21 and bears against the right-hand arm of the lever 18, as viewed in FIG. 2, so as to urge the cam face 17 upwardly and to thereby cause the roller follower 16 to pivot the lever 15 in a clockwise direction.

The means for rocking the lever 18 back and forth includes a link 27 which is mounted on a drive shaft 26 and carries a roller 29 movable into and from engagement with a suitably inclined cam face 18*a* on the left-hand arm of the lever 18, as viewed in FIG. 2. The arrangement is such that the shaft 26 is caused to turn back and forth (see the arrow 28) in synchronism with movements of other mobile components of the spiral binding machine in which the apparatus of FIGS. 2–4 is put to use. When the shaft 26 is rotated in a counterclockwise direction, as viewed in FIG. 2, it causes the link 27 to move the roller 29 to the left of and away from the cam face 18*a*. Therefore, the spring 24 is free to expand and to pivot the lever 18 in a counterclockwise direction whereby the cam face 17 pivots the lever 15 clockwise (because the spring 24 is stronger than the spring 22) and the abutment 7 is moved to the retracted position of FIG. 4. If the shaft 26 is thereupon caused to turn clockwise, as viewed in FIG. 2, the roller 29 engages the cam face 18*a* and pivots the lever 18 clockwise to the position of FIG. 2; therefore, the spring 24 is caused to contract and the spring 22 is free to pivot the lever 15 in a counterclockwise direction so as to move the abutment 7 to the extended position of FIG. 2.

The parts 4 and 4' of the composite abutment at the outer side of the marginal portion 2A are mounted on a holder or crosshead 31 which is secured to an extension 32 of the carrier 13. The extension 31 passes through the opening 6 of the support 1. The reference character 33 denotes an adjustable connection or coupling between the extension 32 of the carrier 13 and the crosshead or holder 31. The purpose of such coupling is to enable an attendant to change the distance between the tips of the parts 4, 4' on the one hand and the surface 1*a* on the other hand if the stack 3 is to be followed by one or more stacks wherein the larger sheet is located at a different distance from the surface 1*a* when the stack is placed onto the support 1. The coupling 33 may comprise a bolt and nut whereby the shank of the bolt extends through a slot in the extension 32 so that the holder 31 can be moved toward or away from the surface 1*a* and is thereupon fixed in the newly selected position. Adjustment in the position of the composite abutment 4, 4' relative to the surface 1*a* is further necessary if the position of the larger sheet 2 with respect to the smaller sheets of a stack 3 which is to be placed onto the support 1 does not change but the thickness of the smaller sheets between the surface 1*a* and the larger sheet 2 changes sufficiently to warrant a movement of the holder 31 toward or away from the support 1 in order to ensure that the composite abutment 4, 4' will entrain all protruding (misaligned) smaller sheets at the outer side of the larger sheet 2 when such composite abutment is moved toward the surface 11*a* of the stop 11.

As mentioned above, the abutments 4, 4' and 7 must be shifted toward the surface 11*a* of the stop 11 in order to cause any protruding (misaligned) smaller sheets of the stack 3 on the support 1 to be properly aligned with the other smaller sheets (namely, with the smaller sheets whose second marginal portions already abut against the stop 11). The directions of such movements of the abutments 7 and 4, 4' are indicated by the double-headed arrow 34, and the shifting unit which causes the abutments 7 and 4, 4' to perform such movements is denoted by the reference character 36. This shifting unit comprises an elongated tie rod or bar 37 which is reciprocable in an elongated guide sleeve 38. The common axis of the rod 37 and sleeve 38 is parallel to the surface 1*a* and is disposed at right angles to the plane of the stack-engaging surface 11*a* of the stop 11. The rod 37 has an elongated tongue or key 39 which extends into a complementary groove of the sleeve 38 so that the rod cannot turn about its axis while being free to move toward and away from the stop 11. The sleeve 38 is affixed to the frame 21 by a fastening device 41 shown in the upper portion of FIG. 4.

The means for moving the rod 37 relative to the sleeve 38, i.e., for shifting the abutments 7 and 4, 4' toward and away from the stop 11, comprises a drive shaft 43 which is rigidly connected with a link 42. The latter carries a motion transmitting pin 44 which abuts against a pin 46 secured to the rod 37. The double-headed arrow 47 denotes the directions in which the shaft 43 is turnable by the main prime mover of the spiral binding machine in synchronism with movements of other parts of the apparatus. The pins 44 and 46 need not be positively coupled to each other, i.e., it suffices that the pin 46 of the rod 37 abut against the pin 44 so that the latter can move the abutments 7 and 4, 4' upwardly and away from the stop 11 when the shaft 43 is caused to turn in a counterclockwise direction, as viewed in FIG. 4. When the shaft 43 is caused to turn clockwise, the pin 46 invariably remains in contact with the descending pin 44 because the inclination of the support 1 suffices to enable the rod 37 to slide by gravity relative to the sleeve 38 and toward the stop 11 as soon as such movement is permitted by the pin 44.

FIGS. 2 to 4 show that the majority of components of the improved apparatus are installed behind the support 1, i.e., at that side of the support which faces away from the surfaces 1*a*. As best shown in FIG. 4, only the composite abutment 4, 4' and the holder means 31 and extension 32 of the carrier 13 extend forwardly or outwardly beyond the surface 1*a*. As mentioned above, the extension 32 of the carrier 13 projects outwardly through the window 6 in the support 1. The abutment 7 extends forwardly and beyond the surface 1*a* only when the lever 15 is caused to assume the angular position of FIG. 2. In all other instances, the abutment 7 is held in the retracted position of FIG. 4 so that it cannot interfere with removal of treated stacks 3 and/or with placing of fresh stacks 3 onto the surface 1*a* of the support 1. The just described mounting of component parts of the improved apparatus is desirable and advantageous because the surface 1*a* of the support 1 is readily accessible and also because nearly all moving parts of the apparatus are shielded at all times due to the fact that they are located behind the support 1. The danger of injury is reduced and the attendants can readily observe the operation of the abutments 7 and 4, 4', i.e., the deformation of the marginal portion 2A and subsequent shifting of abutments 7 and 4, 4' toward the surface 11*a* of the stop 11 in order to effect accurate alignment of all shorter sheets before the thus treated stack is advanced to the next processing station, e.g., to a station where one of its marginal portions (for example, the marginal portion which was adjacent to the stop 11) is provided with a row of perforations for reception of the convolutions of a suitable spiral binder or of the prongs of a twin wire (also known as Wire-O) binder, not shown.

The provision of the two-part abutment 4, 4' allows for such temporary deformation of the marginal portion 2A that the latter exhibits two substantially mirror-symmetrical deformed zones. This reduces the likelihood of twisting of misaligned smaller sheets during shifting toward the surface 11*a* and further enhances the uniformity and predictability of the aligning operation.

The operation of the apparatus of FIGS. 2 to 4 is as follows:

A fresh stack 3 of larger and smaller paper sheets is placed onto the surface 1*a* of the support 1 in a manner as shown in FIG. 4. The second or lower marginal portions of some or all of the sheets (normally including the larger sheet 2) rest on the surface 11*a* of the stop 11, and both abutments (7 and 4, 4') are held in their upper end positions as shown in FIG. 4. Moreover, the abutment 7 is held in the retracted position so that its tip does not project beyond the surface 1*a*. Therefore, the leftmost sheet of the stack 3 shown in FIG. 4 can be placed against the surface 1*a*. The marginal portion 2A of the larger sheet 2 is disposed between the abutments 7 and 4, 4'.

The apparatus is thereupon actuated to deform the marginal portion 2A of the larger sheet 2. As mentioned above, such deformation is initiated by the drive shaft 26 which is caused to turn clockwise, as viewed in FIG. 2, so as to move the link 27 and its roller 29 to the illustrated positions. This causes the cam face 18*a* to turn the lever 18 clockwise, as viewed in FIG. 2, whereby the lever 18 stresses the spring 24 and enables the spring 22 to contract so that the abutment 7 is moved to the extended position and deforms the adjacent section of the marginal portion 2A in cooperation with the parts 4, 4' of the other abutment. When the link 27 is held in the left-hand end position, as viewed in FIG. 2, i.e., when the abutment 7 is retracted, the roller 29 is or can be actually disengaged from the cam face 18*a* and the spring 24 is free to expand either fully or to the extent which is needed to maintain the abutment 7 in its retracted position. The shaft 26 can be rocked by the main shaft of the spiral binding machine so that it turns clockwise, as viewed in FIG. 2, as soon as a stack 3 is properly positioned on the surface 1*a* and all properly aligned sheets of such stack contact the surface 11*a* of the stop 11. If desired, angular movement of the shaft 26 in a clockwise direction, as viewed in FIG. 2, can be initiated by a suitable detector which monitors the surface 1*a* and initiates the generation of a signal as soon as a stack 3 is properly positioned on the locating means including the support 1 and stop 11.

Once the marginal portion 2A is deformed in a manner as shown in FIG. 2, the shaft 43 is caused to turn clockwise, as viewed in FIG. 4, so that the pin 44 allows the rod 37 to descend and to move the abutments 7 and 4, 4' toward the stop 11. This results in automatic alignment of all shorter or smaller sheets because the lower or second marginal portions of any smaller sheets whose upper marginal portions have protruded beyond the upper marginal portions of other smaller sheets (in a direction away from the stop 11) are caused to move toward and into contact with the stop. As explained in connection with FIG. 1, the apparatus may comprise an additional abutment (shown at 200 in FIG. 4) which is designed to move the larger sheet or sheets 2 into contact with the stop 11, preferably before the deformation of the marginal portion 2A begins. This ensures that the marginal portion 2A projects beyond the smaller sheets of the stack 3 on the support 1 to a desired extent before such marginal portion undergoes deformation by the joint action of the abutments 7 and 4, 4' to assume an undulate or a similar shape.

The shifting of abutments 7 and 4, 4' toward the stop 11 results in alignment of all originally misaligned smaller sheets because the deformation or marginal portion 2A entails the separation of both sides of the larger sheet from certain sections of the adjacent smaller sheets. Therefore, the abutments 7 and 4, 4' are compelled to shift the protruding smaller sheets toward the stop 11 when the shaft 43 is caused to rotate in a clockwise direction, as viewed in FIG. 4. Gravitational descent of abutments 7 and 4, 4' against the protruding (if any) upper marginal portions of smaller sheets suffices to cause a shifting of the corresponding smaller sheets toward and into contact with the stop 11 because the stack 3 is not subjected to any stresses in a direction at right angles to and toward the surface 1*a*, i.e., the neighboring sheets of the stack 3 are free to slide relative to each other.

In the next step, the shaft 43 is turned on a counterclockwise direction, as viewed in FIG. 4, so as to return the abutments 7 and 4, 4' (as well as the auxiliary abutment or abutments, if any, for the larger sheet 2) to the upper end positions of FIG. 4. The abutments 7 and 4, 4' are lifted by way of the link 42, pins 44, 46, rod 37, carriage 13, shaft 12, extension 32, coupling 33 and holder 31. The cam face 17 is sufficiently long to remain in continuous contact with the roller follower 16 while the lever 15 shares the (up and down) movements of the rod 37 under the action of the shaft 43 and link 42. If desired, the roller follower 16 can be mounted in such a way that it can roll (rather than slide) along the cam face 17 while the lever 15 is moved by the link 42. All that is necessary is to mount the roller follower 16 for rotation about an axis which is horizontal (rather than vertical), as viewed in FIG. 3.

The shaft 26 can pivot the link 27 in a counterclockwise direction, as viewed in FIG. 2, before, while or after the link 42 moves the abutments 7 and 4, 4' to their upper end positions. The result of counterclockwise movement of the link 27, as viewed in FIG. 2, is that the roller 29 moves away from the cam face 18*a* and the spring 24 expands to pivot the lever 15 clockwise via cam face 17 and roller follower 16. This entails a movement of the abutment 7 back to the retracted position of FIG. 4.

The stack 3 on the support 1*a* is then removed or advanced to the next processing station (e.g., to the aforementioned perforating station preparatory to introduction of a spiral binder or a twin wire binder). At the same time, or immediately or shortly thereafter, a conveyor or an operator places a fresh stack onto the surface 1*a* for the purpose of effecting automatic alignment of all smaller sheets or all sheets of the fresh stack in the aforedescribed manner.

The auxiliary abutment 200 which is shown in FIG. 4 is movable against the marginal portion 2A of a misaligned sheet 2 by a pin 132. The latter is coupled to the shifting means 36 by the carrier 13 and its extension 32.

The provision of locating means with a support 1 having a downwardly sloping surface 1*a* is desirable and advantageous because the originally misaligned smaller sheets begin to move toward the stop 11 as soon as their first marginal portions are engaged by the abutment 7 or 4, 4'. This will be readily appreciated since the inclination of the surface 1*a* is or can be sufficient to promote gravitational movement of misaligned smaller sheets toward the stop 11.

It is clear that the improved apparatus is susceptible of many additional modifications without departing from the spirit of the invention. For example, the levers 15, 18 and links 27, 42 can be replaced by other types of driving and motion transmitting means, such as pneumatically, hydraulically, electromagnetically, electrically or otherwise actuated drive means. Also, the number of abutments at the inner sides of sheets 2 on the support 1 can be increased to two or more, and the number of parts of the abutment at the outer sides of the sheets 2 can be reduced to one (as shown in FIG. 1) or increased to three or more. This depends on the desired reliability of the apparatus and/or on the nature of sheets of which the stacks consist.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising the steps of locating one side of the stack against a first surface; placing the second marginal portions of aligned first sheets against a second surface which is inclined with reference to the first surface whereby the first marginal portions of the misaligned first sheets extend beyond the first marginal portions of first sheets whose second marginal portions contact the second surface; deforming the first marginal portion of the second sheet so as to move at least one section of the thus deformed first marginal portion of the second sheet away from the neighboring section of the first marginal portion of the nearest first sheet, at least at one side of the second sheet; and shifting the misaligned first sheets with reference to the aligned first sheets to move the second marginal portions of misaligned first sheets into contact with the second surface, including applying against the first marginal portions of misaligned first sheets a force acting in a direction toward the second surface in the region of said section of the first marginal portion of said nearest first sheet.

2. The method of claim 1, wherein said deforming step includes imparting to the first marginal portion of the second sheet a substantially undulate shape.

3. The method of claim 2, wherein the first sheets of the stack include first and second piles and the second sheet is disposed between such piles, the first marginal portion of the second sheet having sections which are spaced apart from neighboring sections of first marginal portions of the nearest sheets of the first and second piles upon completion of said deforming step and said shifting step including applying a force against the first marginal portions of misaligned first sheets of both piles in those regions where the sections of first marginal portions of the nearest first sheets are spaced apart from the respective sections of the first marginal portion of the second sheet.

4. The method of claim 2, wherein said imparting step includes holding at least one first section of the first marginal portion of the second sheet against movement away from the first surface and moving a second section of the first marginal portion of the second sheet away from the first surface.

5. The method of claim 2, wherein said imparting step includes urging at least one first section of the first marginal portion of the second sheet toward the first surface and moving a second section of the first marginal portion of the second sheet away from the first surface.

6. The method of claim 1, further comprising the step of applying a force against the first marginal portion of the second sheet in a direction toward the second surface so as to shift the second marginal portion of the second sheet toward and into contact with the second surface if the second marginal portion of the second sheet was out of contact with the second surface upon completion of said locating step.

7. The method of claim 1, wherein the first and second surfaces are substantially flat and the second marginal portion of the second sheet is spaced apart from the second surface upon completion of said locating step, and further comprising the step of shifting the second sheet in parallelism with the first surface so as to move the second marginal portion of the second sheet relative to the aligned first sheets and into contact with the second surface.

8. The method of claim 1, wherein the first and second sheets are rectangular and the plane of the second surface is substantially normal to the plane of the first surface.

9. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets; abutment means; means for shifting said abutment means from a first end position, against the first marginal portions of misaligned first sheets, and toward said second surface on to a second end position to thereby move the second marginal portions of misaligned first sheets into contact with said second surface; and means for moving said abutment means into deforming engagement with the first marginal portion of the second sheet in the stack one side of which contacts said first surface before said shifting means moves said abutment means againt the first marginal portions of misaligned first sheets.

10. The apparatus of claim 9, wherein said locating means includes a substantially plate-like support having an exposed surface which constitutes said first surface and said locating means further includes a stop having an exposed surface which constitute said second surface.

11. The apparatus of claim 9, wherein said first surface slopes downwardly toward said second surface.

12. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets; abutment means; and means for shifting said abutment means from a first end position, against the first marginal portions of misaligned first sheets, and toward said second surface on to a second end position to thereby move the second marginal portions of misaligned first sheets into contact with said second surface, said abutment means including at least one portion which is movable into deforming engagement with the first marginal portion of the second sheet in a stack one side of which is in contact with said first surface to thereby impart to the first marginal portion of the second sheet a substantially undulate shape before such portion of said abutment means is moved by said shifting means into engagement with the first marginal portions of misaligned first sheets on its way toward said second end position.

13. The apparatus of claim 12, wherein said portion of said abutment means is movable between a retracted position and an extended position of deforming engagement with one side of the first marginal portion of the second sheet in a stack one side of which contacts said first surface to thereby move at least one section of the deformed first marginal portion of the second sheet away from the first marginal portion of the nearest first sheet at said one side of the first marginal portion of the second sheet whereby said portion of said abutment means bridges the resulting gap between said section and said nearest first sheet and overlies the first marginal portions of all first sheets at said one side of the first marginal portion of the second sheet.

14. The apparatus of claim 13, wherein said second sheet is disposed between two piles of first sheets so that first sheets are adjacent to both sides of the second sheet, said abutment means including a second portion disposed at the other side of the first marginal portion of the second sheet to contact such other side of the first marginal portion of the second sheet while the latter is deformed by the first mentioned portion of said abutment means.

15. The apparatus of claim 14, wherein the first marginal portion of the second sheet is elongated and said portions of said abutment means are staggered with reference to each other, as considered in the longitudinal direction of the first marginal portion of the second sheet, so that each portion of said abutment means contacts a different section of the first marginal portion of the second sheet when the latter is deformed by said first mentioned portion of said abutment means.

16. The apparatus of claim 15, wherein said one side of the first marginal portion of the second sheet in a stack, one side of which abuts against said first surface, faces said first surface, said first mentioned portion of said abutment means being located at least in part within the confines of said locating means in said retracted position thereof and projecting beyond said first surface in said extended position thereof.

17. The apparatus of claim 9, wherein said first surface is substantially flat and said shifting means includes guide means for confining said abutment means to movement along a path extending in substantial parallelism with the plane of said first surface.

18. The apparatus of claim 17, wherein said second surface is substantially normal to said first surface and said path extends substantially at right angles to said second surface.

19. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets; abutment means including a first portion at one side of the first marginal portion of said second sheet and a second portion at the other side of the first marginal portion of the second sheet, one of said portions of said abutment means including spaced-apart first and second parts, as considered in the longitudinal direction of the first marginal portion of the second sheet, and the other portion of said abutment means being disposed between such parts of said one portion of said abutment means; and means for shifting said abutment means from a first end position, against the first marginal portions of misaligned first sheets, and toward said second surface on to a second end position to thereby move the second marginal portions of misaligned first sheets into contact with said second surface.

20. The apparatus of claim 19, further comprising means for moving said other portion of said abutment means against the adjacent section of the first marginal portion of the second sheet prior to shifting of said abutment means toward said second surface so that said portions of said abutment means cooperate to impart to the first marginal portion of the second sheet a substantially wave-like configuration.

21. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets; abutment means; and means for shifting said abutment means from a first end position, against the first marginal portions of misaligned first sheets, and toward said second surface on to a second end positions to thereby move the second marginal portions of misaligned first sheets into contact with said second surface, said abutment means including means for stiffening the first marginal portion of the second sheet prior to shifting of said abutment means toward said second surface.

22. The apparatus of claim 9, wherein said locating means includes a member defining said first surface and having an opening, said abutment means including a portion which registers with said opening and is movable beyond said first surface into engagement with the first marginal portion of the second sheet of a stack one side of which contacts said first surface.

23. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means including a member having an opening and defining a first surface arranged to contact one side of the stack to be treated in said apparatus, said locating means further having a second surface which is inclined with reference to said first surface and is arranged to contact the second marginal portions of aligned first sheets; abutment means including a portion which registers with said opening and is movable beyond said first surface into engagement with the first marginal portion of the second sheet of a stack one side of which contacts said first surface, said portion of said abutment means being movable between a retracted position in which said portion of said abutment means is out of contact with the stack one side of which contacts said first surface and an extended position of deforming engagement with the first marginal portion of the second sheet of such stack; means for moving said portion of said abutment means between said retracted and extended positions; and means for shifting said abutment means from a first end position, against the first marginal portions of misaligned first sheets, and toward said second surface on to a second end position to thereby move the second marginal portions of misaligned first sheets into contact with said second surface.

24. The apparatus of claim 23, wherein said moving means comprises a linkage including at least one pivotable lever and means for pivoting said lever.

25. The apparatus of claim 24, wherein said pivoting means includes resilient means.

26. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets, one side of the first marginal portion of the second sheet in a stack, one side of which contacts said first surface, facing said first surface and the other side of the first marginal portion of the second sheet facing away from said first surface, said locating means including a member which defines said first surface and has an opening, abutment means including a portion adjacent to the other side of the first marginal portion of the second sheet; carrier means located behind said member of said locating means and including an extension projecting through said opening and supportingly connected with said portion of said abutment means; and means for shifting said abutment means from a first end position, against the first marginal portions of misaligned first sheets, and toward said second surface on to a second end position to thereby move the second marginal portions of misaligned first sheets into contact with said second surface.

27. The apparatus of claim 26, wherein said shifting means is located behind said member of said locating means and includes means for reciprocating said portion of said abutment means by way of said extension of said carrier means.

28. The apparatus of claim 9, wherein said locating means includes a member having a first side which constitutes said first surface and a second side facing away from the stack which contacts said first surface, said shifting means being adjacent to said second side of said member of said locating means.

29. The apparatus of claim 28, wherein said member of said locating means has a window and said abutment means includes at least one portion which extends through said window and beyond said first surface, at least while said shifting means is in the process of moving said abutment means toward said second surface.

30. The apparatus of claim 9 for treating stacks wherein the second marginal portions of aligned first sheets extend beyond the second marginal portion of the second sheet when said one side of the respective stack is placed in contact with said first surface, and further comprising auxiliary abutment means and means for moving said auxiliary abutment means against the first marginal portion of the second sheet of a stack one side of which contacts said first surface and thereupon toward said second surface to thereby shift the second marginal portion of the second sheet into contact with the second surface.

31. The apparatus of claim 30, further comprising means for coupling said means for moving said auxiliary abutment means to said shifting means.

32. Apparatus for aligning the sheets of a stack which includes aligned and misaligned relatively small first sheets and at least one relatively large second sheet having a first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets; abutment means including a portion which is a part of a pivotable lever; and means for shifting said abutment means from a first end position, against the first marginal portions of misaligned first sheets, and toward said second surface on to a second end position to thereby move the second marginal portions of misaligned first sheets into contact with said second surface.

33. The apparatus of claim 9, wherein said abutment means comprises a portion which is disposed at a fixed distance from said first surface.

34. Apparatus for aligning the sheets of a stack which includes aligned and misaligned relatively small first sheets and at least one relatively large second sheet having an elongated first marginal portion extending beyond the corresponding first marginal portions of the first sheets, wherein the first marginal portions of misaligned first sheets extend beyond the first marginal portions of aligned first sheets, and wherein the sheets have second marginal portions located opposite the respective first marginal portions and the second marginal portions of aligned first sheets extend beyond the second marginal portions of misaligned first sheets, comprising locating means having a first surface arranged to contact one side of the stack to be treated in said apparatus and a second surface which is inclined with reference to said first surface and is arranged to contact the second marginal portions of aligned first sheets; abutment means comprising a portion disposed at a fixed distance from said first surface, said portion of said abutment means including a plurality of parts which are spaced apart from each other, as considered in the longitudinal direction of the first marginal portion of the second sheet; and means for shifting said abutment means from a first end position, against the first marginal portions of misaligned first sheets, and toward said second surface on to a second end position to thereby move the second marginal portions of misaligned first sheets into contact with said second surface, said parts of said portion of said abutment means contacting one side of the first marginal portion of the second sheet while said shifting means moves said abutment means toward said second surface.

* * * * *